United States Patent [19]

Tabbert

[11] Patent Number: 4,673,174

[45] Date of Patent: Jun. 16, 1987

[54] ANGLE CLAMPING TOOL

[76] Inventor: William D. Tabbert, 1040 21st St., Springfield, Oreg. 97477

[21] Appl. No.: 884,415

[22] Filed: Jul. 11, 1986

[51] Int. Cl.[4] ..... B25B 1/20

[52] U.S. Cl. ..... 269/41; 269/228; 269/238; 269/266; 269/268; 269/258; 269/329; 81/420

[58] Field of Search ..... 269/41, 42, 37, 238, 269/258, 266, 268, 228, 272, 329; 81/367, 368, 370, 371, 420, 424, 418; 29/268, 281.1; 33/451

[56] References Cited

U.S. PATENT DOCUMENTS

| | | | |
|---|---|---|---|
| 1,368,399 | 2/1921 | Jerrim | 269/258 |
| 1,406,262 | 2/1922 | Kronert | 33/451 |
| 2,366,350 | 1/1945 | Ostling | 269/258 |
| 2,724,296 | 11/1955 | Parrish et al. | 269/268 |
| 3,314,319 | 4/1967 | Schmidt . | |
| 3,446,102 | 5/1969 | Hallmark . | |
| 3,908,490 | 9/1975 | Durham . | |
| 4,134,578 | 1/1979 | Stanley | 269/258 |
| 4,305,575 | 12/1981 | Bardes . | |
| 4,344,215 | 8/1982 | Dearman . | |
| 4,483,059 | 11/1984 | Dearman . | |
| 4,553,305 | 11/1985 | Dearman . | |
| 4,559,853 | 12/1985 | Oye | 81/420 |
| 4,571,824 | 2/1986 | Ingaglio | 29/268 |
| 4,601,221 | 7/1986 | Kalkbrenner et al. | 269/258 |

FOREIGN PATENT DOCUMENTS

| | | | |
|---|---|---|---|
| 174872 | 5/1953 | Austria | 269/268 |
| 2836506 | 3/1980 | Fed. Rep. of Germany | 269/41 |

*Primary Examiner*—Robert C. Watson

*Attorney, Agent, or Firm*—Klarquist, Sparkman, Campbell, Leigh & Whinston

[57] ABSTRACT

An angle clamping tool is provided having a handle including a lockable clamping mechanism operably connected to two jaw arms. Each jaw arm includes an end portion and a medial portion. Secured to the end portion of each jaw arm is a clamping jaw comprising a pair of two elongate clamp members. The clamp members are adjustable to form a selected angular relationship with respect to each other, depending on the types of materials being secured together and the uses for such materials. Once a selected angle is obtained, means are provided for locking the clamp members in such angle during use. The jaw arms in the invention are designed so that, when the handle portion is gripped, the clamping jaws move inwardly toward each other so as to meet and engage work pieces therebetween. The jaw arms are further designed so that when the clamping jaws meet, the medial portions of the jaw arms are sufficiently spaced from each other to permit passage of the clamped work pieces therebetween. Once the work pieces are clamped between the jaw arms, they may be locked in such position by a locking mechanism in the handle portion of the device.

13 Claims, 5 Drawing Figures

ANGLE CLAMPING TOOL

The present invention generally relates to clamping tools, and more particularly to a clamping tool having adjustable jaws adapted to engage materials together in an angled relationship.

BACKGROUND OF THE INVENTION

A variety of clamping tools have been developed for both home and commercial use. These tools are used for numerous purposes, and include many different types of clamping systems.

For example, U.S. Pat. No. 4,305,575 to Bardes discloses a clamping tool designed for securing wood framing members together. The Bardes device includes a handle having a lockable clamping mechanism operably connected to a pair of rigid L-shaped jaws which are also L-shaped in cross section. Each jaw has a plurality of frictional gripping barbs to facilitate engagement of the wood framing members.

U.S. Pat. No. 3,446,102 to Hallmark discloses a tool having a handle with a lockable clamping mechanism connected to two jaw arms. Each jaw arm includes a plurality of extension members secured together in a telescoping arrangement, permitting the length of the jaw arms to be adjusted. At the end of each jaw arm is an L-shaped jaw member having an enlarged head.

U.S. Pat. No. 3,314,319 to Schmidt discloses a hand tool having a handle with an adjustable locking mechanism and a pair of opposing jaws. Each jaw includes a first blade and a second blade parallel to and interiorly disposed from the first blade. The device is adapted for use in securing portions of metal duct work together.

U.S. Pat. No. 3,908,490 to Durham discloses a hand tool for mounting truck tires. The tool includes a handle with a lockable clamping mechanism connected to two opposed, curved jaw plates. The jaw plates are designed to clamp a metal wheel rim during the mounting of a tire to retain the tire bead in place on the rim.

U.S. Pat. Nos. 4,483,059, 4,344,215, and 4,553,305 to Dearman all disclose pipefitting tools having V-shaped jaws adapted to engage a pipe therebetween. The '305 and '059 patents further include scribe means for marking the pipes as desired during assembly.

Although the above-described tools perform a variety of important functions, none are adapted to secure a plurality of work pieces together in a selected angled relationship. It is often necessary in the construction trade, or during home use, to secure two portions of material together in an angled configuration so that both portions may be permanently secured in such configuration. For example, in metalworking, it is often necessary to secure two pieces of metal together at an angle so that such pieces can be permanently welded. Likewise, the securing together of materials in an angled configuration is important in work involving wood, glass, and other construction materials. Thus, a need exists for a tool adapted to engage materials together in an angled relationship so that such materials can be permanently bonded. The present invention satisfies this need.

SUMMARY OF THE INVENTION

It is an object of the present invention to provide an angle clamping tool usable to secure a plurality of work pieces together in an angled relationship.

It is another object of the present invention to provide an angle clamping tool having the ability to clamp work pieces together in an angled relationship which may be varied by the user of the tool as desired.

It is a further object of the present invention to provide an angle clamping tool which includes a locking system for maintaining said work pieces together in said angled relationship so that such pieces may be easily worked on.

It is a still further object of the present invention to provide an angle clamping tool usable to secure a variety of different materials together for various purposes.

It is an even further object of the present invention to provide an angle clamping tool which is simple to use and easy to adjust.

To accomplish these objectives, an angle clamping tool is provided having a handle portion including a lockable clamping mechanism operably connected to upper and lower jaw arms. Each jaw arm includes an end portion and a medial portion. Secured to the end portion of each jaw arm is a jaw comprising a pair of elongate clamp members each having a first end, a second end, and a longitudinal gripping edge. To construct each jaw, the first ends of both clamp members are pivotally secured to the end portion of one of the jaw arms. As a result of this construction, the clamp members are adjustable in a selected angular relationship with respect to each other, depending on the types of materials being secured together and the uses for such materials. Once a selected angle is obtained, the invention also includes means for locking the clamp members in such angle during use. The jaw arms of the invention are designed so that when the handle portion is gripped, the jaws move inwardly toward each other so as to meet and engage work pieces between the gripping edges of the clamp members. The jaw arms are further designed so that when the jaws meet, the medial portions of the jaw arms are sufficiently spaced from each other to permit passage of the clamped work pieces therebetween. Once the work pieces are clamped between the jaws, they may be locked in such position by a locking mechanism in the handle portion of the device.

These and other objects, features, and advantages of the invention will become apparent from the following detailed description of a preferred embodiment and accompanying drawing figures.

BRIEF DESCRIPTION OF THE DRAWINGS

The present invention 10 represents an improved clamping tool specially designed to engage and retain work pieces in a selected angled relationship. As shown in FIGS. 1 and 2, the invention 10 includes as its major components a handle portion 12 and pivotally movable upper and lower arms 14, 16 extending outwardly from the handle portion 12. Secured to the ends 18, 20 of the upper and lower arms 14, 16 are upper and lower jaws 22, 24.

The handle portion 12 is preferably of the type sold by the Peterson Manufacturing Company of DeWitt, Nebraska under the trademark Vice Grip ®. Generally, the handle portion 12 includes a lower gripping member 26 having a release lever 28 pivotally attached at position 30 (FIG. 2). Release lever 28 is adapted to engage a toggle link 32 which is pivotally secured to lower gripping member 26 at position 34. With reference to FIG. 2, the upper end 36 of the toggle link 32 engages a stop screw 38 having an enlarged, knurled head 40. The stop screw 38 is threadably disposed within an opening 42 in end 43 of an upper gripping member 44. Secured within the upper gripping member 44 at position 46 is a tension spring 48 to facilitate release by the invention 10 of clamped work pieces. The aforesaid elements within handle portion 12 cooperate to form a releasible locking mechanism permitting work pieces to be gripped and released by the invention 10.

Figure 2:
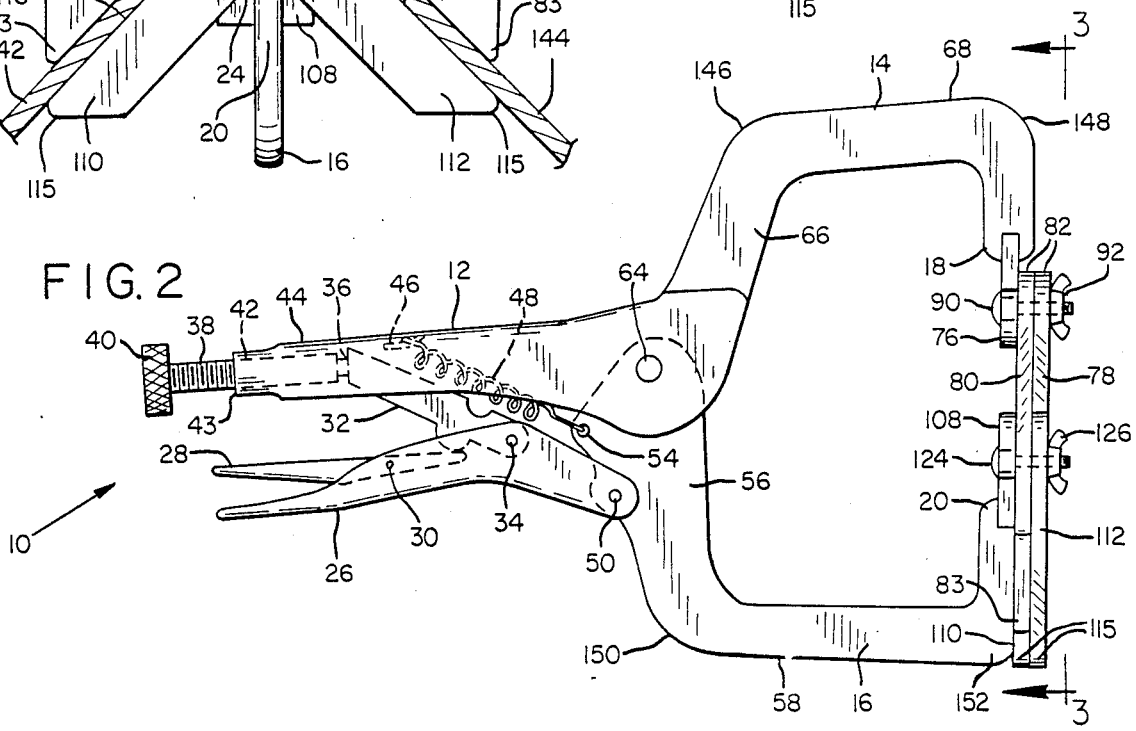
FIG. 2 is a side elevational view of the invention.

Pivotally secured to the lower gripping member 26 at position 50 is lower arm 16. The lower arm 16 is secured to the tension spring 48 at position 54, and includes a downwardly-extending primary portion 56, a medial portion 58, and end portion 20 (FIG. 2).

Extending outwardly from the upper gripping member 44 is upper arm 14. The upper arm 14 may be integral with the upper gripping member 44, or may be separate from and fixedly linked to the upper gripping member 44. The upper arm 14 is also pivotally mounted to the lower arm 16 at position 64, and includes an upwardly-extending primary portion 66, a medial portion 68, and end portion 18.

Figure 1:
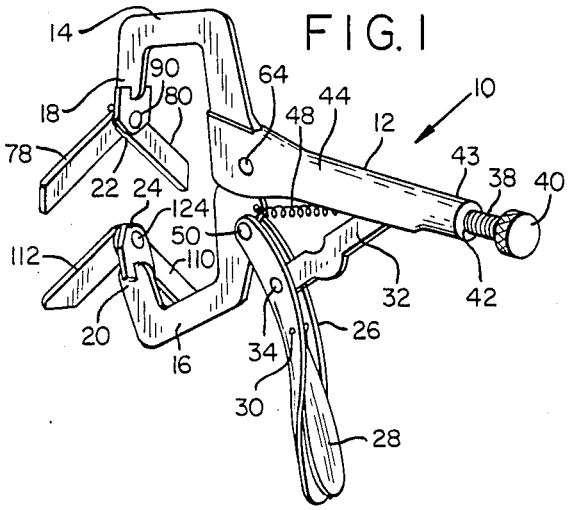
FIG. 1 is a perspective view of the present invention.
Figure 4:
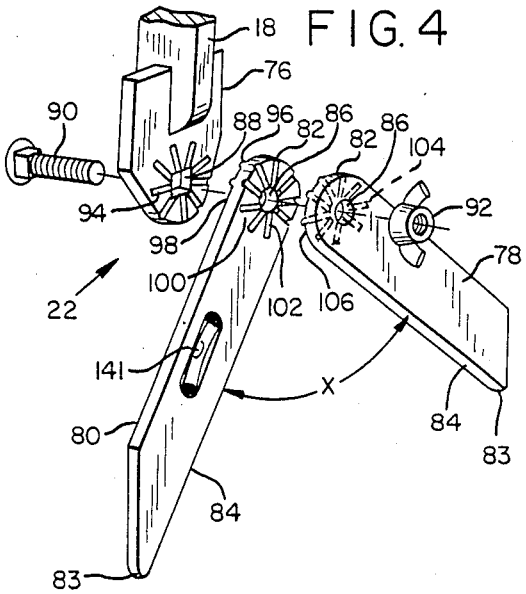
FIG. 4 is an exploded perspective view of the upper jaw of the invention.
Figure 5:
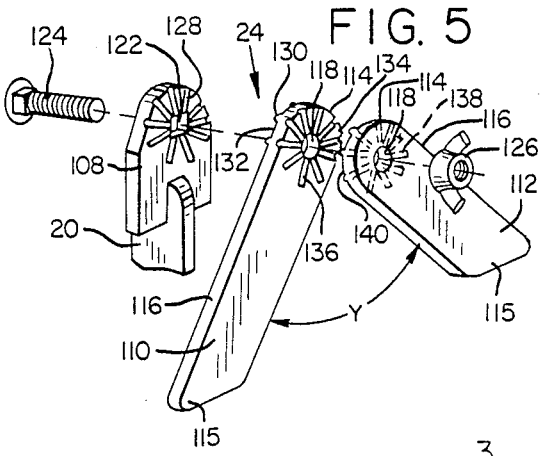
FIG. 5 is an exploded perspective view of the lower jaw of the invention.

Secured to the end portions 18, 20 are upper and lower jaws 22 and 24 (FIGS. 4 and 5). The upper jaw 22 includes a plate 76 at end portion 18, and two clamp members 78, 80. Each clamp member 78, 80 is elongate, substantially planar, and includes a first end 82, a second end 83, and a longitudinal gripping edge 84. Each of the clamp members 78, 80 also includes a bore 86.

To secure the clamp members 78, 80 to the plate 76, the first end 82 of clamp member 78 is placed over the first end 82 of the clamp member 80. Both clamp members 78, 80 are then positioned on plate 76, making certain that bores 86 of the clamp members 78, 80 are aligned with a bore 88 in the plate 76. The clamp members 78, 80 are then oriented in a selected angular relationship with respect to each other (preferably between 5°–90°), and are secured to the plate 76 in such relationship by the insertion of a screw 90 through bores 86, 88 and subsequent attachment of a nut 92 to the screw 90. The angle formed by clamp members 78, 80 with respect to each other is designated in FIG. 4 by the letter "X."

A variety of methods may be used to maintain the clamp members 78, 80 in a desired angular relationship. A preferred method is shown in FIG. 4. Provided on a plate 76 and surrounding the bore 88 is a plurality of indentations 94 in a selected pattern. These indentations 94 correspond in size, shape, and pattern to a plurality of upwardly-extending projections 96 on the underside 98 of the clamp member 80. Likewise, the top side 100 of the clamp member 80 includes a plurality of indentations 102 which correspond in size, shape, and pattern to a plurality of upwardly-extending projections 104 on the underside 106 of clamp member 78. By selective engagement of the upwardly-extending projections 104 with the indentations 102 and engagement of the indentations 94 with the upwardly-extending portions 96, the clamp members 78, 80 are maintained in a desired orientation.

In a like manner, the lower jaw 24 as shown in FIG. 5 includes a plate 108 at end portion 20, and two clamp members 110, 112. The clamp members 110, 112 are similar in size and shape to clamp members 78, 80. Each clamp member 110, 112 includes a first end 114, a second end 115, and a longitudinal gripping edge 116. The clamp members 110, 112 also each include a bore 118.

To secure the clamp members 110, 112 to the plate 108, the first end 114 of the clamp member 112 is placed over the first end 114 of the clamp member 110. Both clamp members 110, 112 are then positioned on the plate 108, making certain that bores 118 in the clamp members 110, 112 are aligned with a bore 122 in the plate 108. The clamp members 110, 112 are then oriented in a selected angular relationship with respect to each other (preferably between 5°–90°), and are secured to the plate 108 by the insertion of a screw 124 through bores 118, 122 and attachment of a nut 126 to the screw 124. The angle formed by clamp members 110, 112 with respect to each other is designated in FIG. 5 by the letter "Y."

The clamp members 110, 112 are maintained in a desired angular relationship using a system similar to that described above for clamp members 78, 80. Specifically, provided on plate 108 and surrounding the bore 122 is a plurality of indentations 128 in a selected pattern. These indentations correspond in size, shape, and pattern to a plurality of upwardly-extending projections 130 on the underside 132 of clamp member 110. In a like manner, provided on the top side 134 of the clamp member 110 is a plurality of indentations 136 corresponding in size, shape, and pattern to a plurality of upwardly-extending projections 138 on the underside 140 of clamp member 112. The clamp members 110, 112 are then secured in position as described above for clamp members 78, 80.

Numerous other methods may be used to maintain the clamp members in a selected angled relationship, including a variety of frictional engagement systems known in the art. Furthermore, the location of the indentations and upwardly-extending projections as described above may be reversed. For example, plate 108 may include a plurality of projections instead of indentations and the underside 132 of clamp member 110 may include a plurality of indentations to engage such projections.

To protect delicate materials which may be clamped in the invention 10, an optional rubber edging may be applied to the clamp members 78, 80, 110, 112. It may also be possible to fit a protective sleeve over the clamp members to accomplish the same purpose. Preferred materials for this purpose would involve rubber or rubberized plastic. Furthermore, one or more of the clamp members 78, 80, 110, 112 may have a bubble-type level device 141 therein to facilitate proper orientation of both the invention 10 and work pieces clamped therein (FIG. 4).

OPERATION

Figure 3:
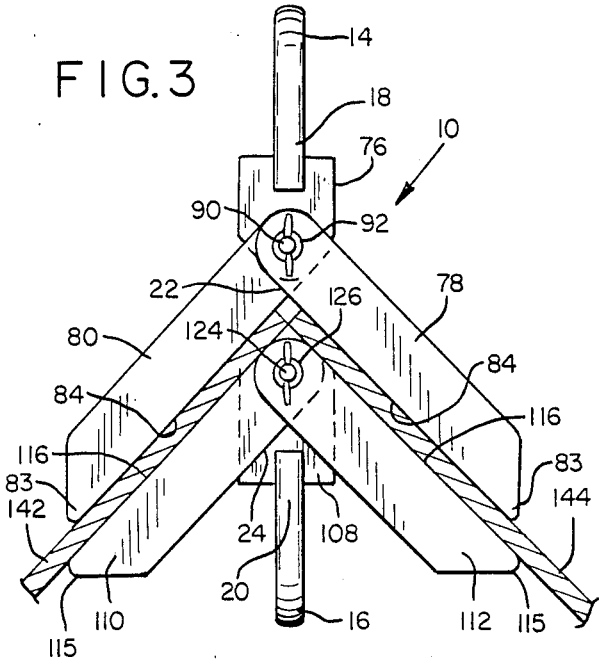
FIG. 3 is a front elevational view of the invention taken along lines 3—3 of FIG. 2.

To use the invention 10, the release lever 28 in the lower gripping member 26 of the handle 12 is pressed downward. This action causes the tension spring 48 to urge the upper and lower jaws 22, 24 into an open position. The clamp members 78, 80, 110, 112 of the jaws are then adjusted as described above, with angle "X" being equal to angle "Y." Once the desired work pieces are placed between the jaws 22, 24, the upper gripping member 44 and lower gripping member 26 are squeezed causing the upper and lower jaws 22, 24 to move inwardly toward each other. As a result, the longitudinal gripping edges 84, 116 of the clamp members 78, 80, 110, 112 come into abutting engagement with the work pieces. Through the well-known action of the above-described components in the handle portion 12, the work pieces are then locked in position. Depending on the thickness of the work pieces, the locking mechanism in the handle portion 12 may be adjusted using the stop screw 38. FIG. 3 shows two work pieces 142, 144 locked in position between the jaws 22, 24.

To accommodate large work pieces, the upper and lower arms 14, 16 are designed so that their medial portions 58, 68 are sufficiently spaced to permit passage of the work pieces therebetween. This is accomplished by the placement of bends 146 and 148 in the upper arm 14, and bends 150 and 152 in the lower arm 16, as shown in FIG. 2. In an alternative embodiment, the upper and lower arms 14, 16 may be constructed to resemble a semi-circle, thereby accomplishing the same purpose as does the embodiment shown in FIG. 2.

To release the materials from the invention 10, the release lever 28 is pressed, causing the jaws 22, 24 to open through the action of the tension spring 48.

While but one embodiment of the invention has been shown herein, it will be apparent to those skilled in the art that the invention may be varied without departing from the spirit and scope of the invention as defined in the following claims.

I claim:

1. In a clamping tool having a handle portion in association with a locking mechanism, the improvement comprising:

upper and lower arms extending outwardly from said handle portion;

an upper jaw secured to said upper arm, said upper comprising a pair of elongate clamp members each having first and second ends, said first ends of said clamp members being pivotally secured to said upper arm so as to allow said clamp members to be positioned in a selected angled relationship with respect to each other;

means for maintaining said clamp members of said upper jaw in said angled relationship during the use of said tool;

a lower jaw secured to said lower arm, said lower jaw comprising a pair of elongated clamp members each having first and second ends, said first ends of said clamp members being pivotally secured to said lower arm so as to allow said clamp members to be positioned in a selected angle relationship with respect to each other;

means for maintaining said clamp members of said lower jaw in said angled relationship during the use of said tool; and each of said clamp members of said upper and lower jaws comprising a longitudinal gripping edge, said upper and lower jaws being adjustable to enable the grippng edges of said upper jaw to form an angle equivalent to that formed by said gripping edges of said lower jaw so that said upper and lower jaws can meet and engage two planar work pieces therebetween in an angled configuration.

2. The clamping tool of claim 1 wherein said clamp members of said upper jaw are adapted to form a 5°–90° angle with respect to each other.

3. The clamping tool of claim 1 wherein said clamp members of said lower jaw are adapted to form a 5°–90° angle with respect to each other.

4. The clamping tool of claim 1 wherein at least one of said clamp members of said upper and lower jaws comprises a bubble-type level device therein.

5. The clamping tool of claim 1 wherein said clamp members of said upper and lower jaws further comprise a non-abrasive material secured about the exterior thereof.

6. The clamping tool of claim 5 wherein said non-abrasive material comprises rubber.

7. The clamping tool of claim 1 wherein said upper and lower arms comprise end portions to which said upper and low jaws are secured, and medial portions between said end portions and said handle portion, said upper and lower arms being constructed so that when work pieces are engaged between said upper and lower jaws, said medial poritions of said upper and lower arms are spaced from each other in an amount sufficient to permit said work pieces to be passed therebetween.

8. In a clamping tool having a handle portion in association with a locking mechanism, the improvement comprising:

pivotally movable upper and lower arms extending outwardly from said handle portion;

an upper jaw secured to said upper arm, said upper jaw comprising a pair of elongate clamp members each having first and second ends, said first ends of said clamp members being pivotally secured to said upper arm so as to allow said clamp members to be positioned to form a 5° to 90° angle with respect to each other;

means for maintaining said clamp members of said upper jaw in said angle during the use of said tool;

a lower jaw secured to said lower arm, said lower jaw comprising a pair of elongated clamp members esach having first and second ends, said first ends of said clamp members being pivotally secured to said lower arm so as to allow said clamp members to be positioned to form a 5° to 90° angle with respect to each other;

means for maintaining said clamp members of said lower jaw in said angle during the use of said tool; and each of said clamp members of said upper and lower jaws comprising a longitudinal gripping edge, said upper and lower jaws being adjustable to enable the gripping edges of said upper jaw to form an angle equivalent to that formed by said gripping edges of said lower jaw so that said upper and lower jaws can meet and engage two planar work pieces therebetween in an angled configuration.

9. The clamping tool of claim 7 wherein at least one of said clamp members of said upper and lower jaws comprises a buble-type level device therein.

10. The clamping tool of claim 7 wherein said clamp members of said upper and lower jaws further comprise a non-abrasive material secured about the exterior thereof.

11. The clamping tool of claim 9 wherein said non-abrasive material comprises rubber.

12. The clamping tool of claim 7 wherein said upper and lower arms comprise end portions to which said upper and lower jaws are secured, and medial portions between said end portions and said handle portion, said upper and lower arms being constructed so that when work pieces are engaged between said upper and lower jaws, said medial portions of said upper and lower arms are spaced from each other in an amount to permit said work pieces to be passed therebetween.

13. In a clamping tool having a handle portion in association with a locking mechanism, the improvement comprising:

upper and lower arms extending outwardly from said handle portion;

an upper jaw secured to said upper arm, said upper jaw comprising a pair of elongate clamp members each having first and second ends, said first ends of said clamp members being pivotally secured to said upper arm so as to allow said clamp members to be positioned to form a 5° to 90° angle with respect to each other;

means for maintaining said clamp members of said upper jaw in said angle during the use of said tool;

a lower jaw secured to said lower arm, said lower jaw comprising a pair of elongate clamp members each having first and second ends, said first ends of said clamp members being pivotally secured to said lower arm so as to allow said clamp members to be positioned to form a 5° to 90° angle with respect to each other;

means for maintaining said clamp members of said lower jaw in said angle during the use of said tool;

each of said clamp members of said upper and lower jaws comprising a longitudinal gripping edge, said upper and lower jaws being adjustable to enable the gripping edges of said upper jaw to form an angle equivalent to that formed by said gripping edges of said lower jaw so that said upper and lower jaws can meet and engage two planar work pieces therebetween in an angled configuration; and said upper and lower arms comprising end portions to which said upper and lower jaws are secured, and medial portions between said end portions and said handle portion, said upper and lower arms being constructed so that when work pieces are engaged between said upper and lower jaws, said medial portions of said upper and lower arms are spaced from each other in an amount sufficient to permit said work pieces to be passed therebetween.

* * * * *

UNITED STATES PATENT AND TRADEMARK OFFICE

CERTIFICATE OF CORRECTION

PATENT NO. : 4,673,174

DATED : June 16, 1987

INVENTOR(S) : WILLIAM D. TABBERT

It is certified that error appears in the above-identified patent and that said Letters Patent are hereby corrected as shown below:

Column 5, Claim 1, line 37, after "upper" , second occurrence insert -- jaw --.

Column 6, Claim 8, line 38, "esach" should be --each--.

Column 7, Claim 12, line 2, after "amount" insert --sufficient--.

Signed and Sealed this

Thirteenth Day of October, 1987

*Attest:*

*Attesting Officer*

DONALD J. QUIGG

*Commissioner of Patents and Trademarks*